United States Patent [19]

Gneiting et al.

[11] 4,136,663

[45] Jan. 30, 1979

[54] HEATING UNIT

[76] Inventors: Derrell A. Gneiting; John A. Gneiting, both of 856 E. Newport, Hermiston, Oreg. 97838

[21] Appl. No.: 766,044

[22] Filed: Feb. 7, 1977

[51] Int. Cl.[2] ..... F24C 1/14

[52] U.S. Cl. ..... 126/63; 126/66; 126/69; 126/70

[58] Field of Search ..... 126/67, 69, 4, 61, 6, 126/63, 66, 70, 106; 165/DIG. 2, 102

[56] References Cited

U.S. PATENT DOCUMENTS

| | | | |
|---|---|---|---|
| 42,459 | 4/1864 | Buttles | 165/102 |
| 150,047 | 4/1874 | Hyde | 126/6 |
| 306,878 | 10/1884 | Turner et al. | 126/6 |
| 697,091 | 4/1902 | Kistler | 126/4 |
| 2,083,145 | 6/1937 | Campbell | 126/4 |
| 2,144,291 | 1/1939 | Henderson | 126/4 |

*Primary Examiner*—William E. Wayner
*Assistant Examiner*—William E. Tapolcai
*Attorney, Agent, or Firm*—Eugene M. Eckelman

[57] ABSTRACT

An inner shell is incorporated within an outer shell and is of smaller dimensions to provide side spaces for the upward flow of heat, a top space communicating with an outlet, and a rear space having a V-shaped baffle therein causing upward flow of heat in the rearward area to be circulated and slowed for increased heating efficiency. An extension is attachable to the baffle for extending it upwardly and forwardly to control the flow of heat at the baffle. The inner shell has an imperforate tray extending from side to side and arranged to be moved forwardly through an opening in the inner shell and providing a natural forced flow of heat around it from the bottom for heating room areas.

9 Claims, 7 Drawing Figures

HEATING UNIT

BACKGROUND OF THE INVENTION

This invention relates to new and useful improvements in heating units such as for example a stove arranged for home use.

Many types of stoves have heretofore been provided for burning wood, coal, and the like, and intended primarily to furnish heat to room areas. Such stoves in general provide an inefficient manner of heating since a great portion of the heat flows directly up the flue and is lost. Various types of heat traps have been provided, but such traps produce a complicated structure and are difficult to manufacture in an economical manner.

SUMMARY OF THE INVENTION

According to the present invention and forming a primary objective thereof, a heating unit is provided which is simplified in construction and which at the same time utilizes efficiently the heat produced from a source such as a stove for cooking articles and also for heating room areas.

The objectives of the invention are accomplished by the use of outer and inner shell means with the inner shell being of smaller dimension than the outer shell to provide heating air passageways therearound. V-shaped baffle means are provided behind the inner shell and provide a circulation and slowing of the heat flow to produce an efficient heating of the heating unit and a maximum radiation of heat into the room. This structure may be utilized with a stove for receiving its heat therefrom or with other sources such as a fireplace. Means are provided in the inner shell to cause a natural forced flow of air into and out of the unit for heating room areas.

The invention will be better understood and additional objects and advantages will become apparent from the following description taken in connection with the accompanying drawings.

DETAILED DESCRIPTION OF PREFERRED EMBODIMENTS

Figure 1:
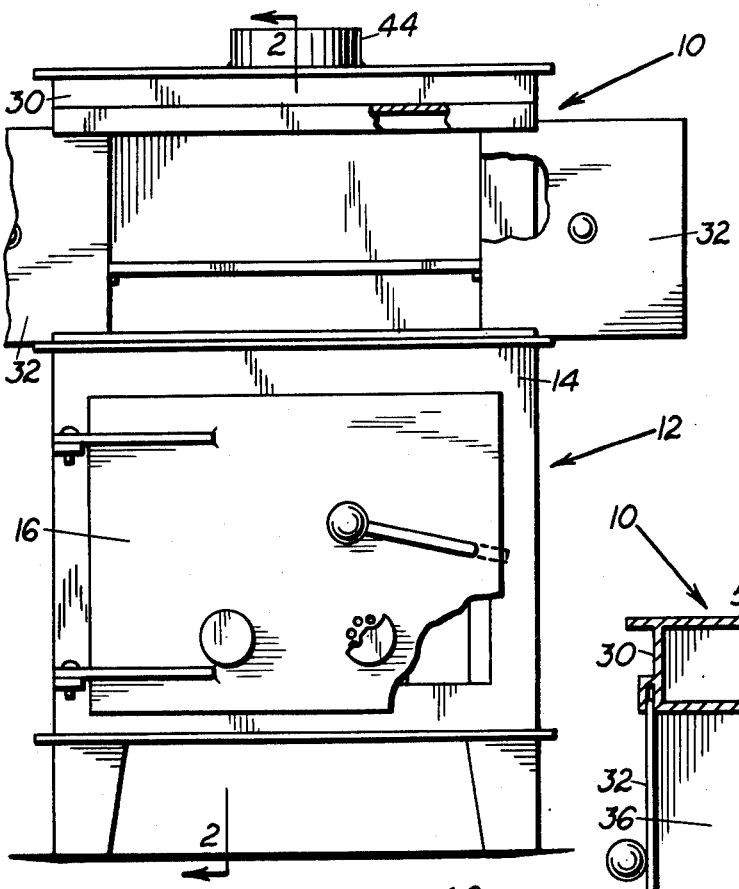
FIG. 1 is a front elevational view, partly broken away, of a heating unit embodying principles of the present invention.

With reference first to FIGS. 1-4, the present invention is designated generally by the numeral 10 and is intended for use with a heating source to supply heat thereto such as a stove, fireplace, or other means. In the present disclosure, the heating unit is shown in combination with a stove of a usual type which has a front wall 14 with a door 16 therein, a rear wall 18, side walls 20, a top wall 22, and a bottom wall 24, such walls forming a fire chamber 26 with the usual fire brick 28 therein.

The heating unit 10 comprises a front wall 30 having sliding doors 32 therein, a rear wall 34, side walls 36, a top wall 38, and a bottom wall 40.

The box-like structure defined by the walls 30, 34, 36, 38 and 40 is confined at the top, sides and rear by a larger shell formed by a rear wall 34*a* which may comprise a vertical extension of stove wall 18, side walls 36*a* which may comprise vertical extensions of stove walls 20, and a top wall 42 having a tubular projection 44 for receiving a stovepipe 46 shown in broken lines. The wall portions 34*a*, 36*a* and 42 form with the respective wall portions 34, 36 and 38 a rear space 48, side spaces 50, and a top space 52.

Figure 4:
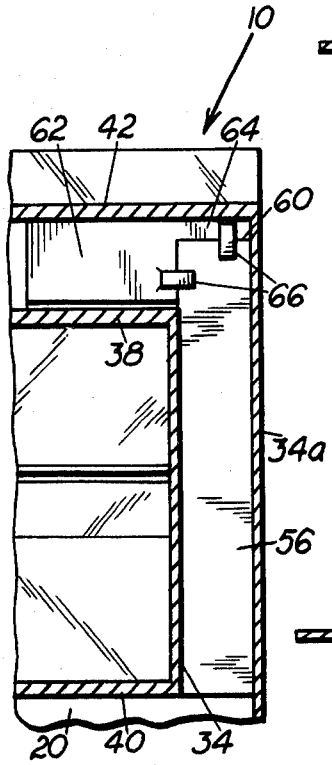
FIG. 4 is a fragmentary sectional view taken on the line 4—4 of FIG. 3.
Figure 2:
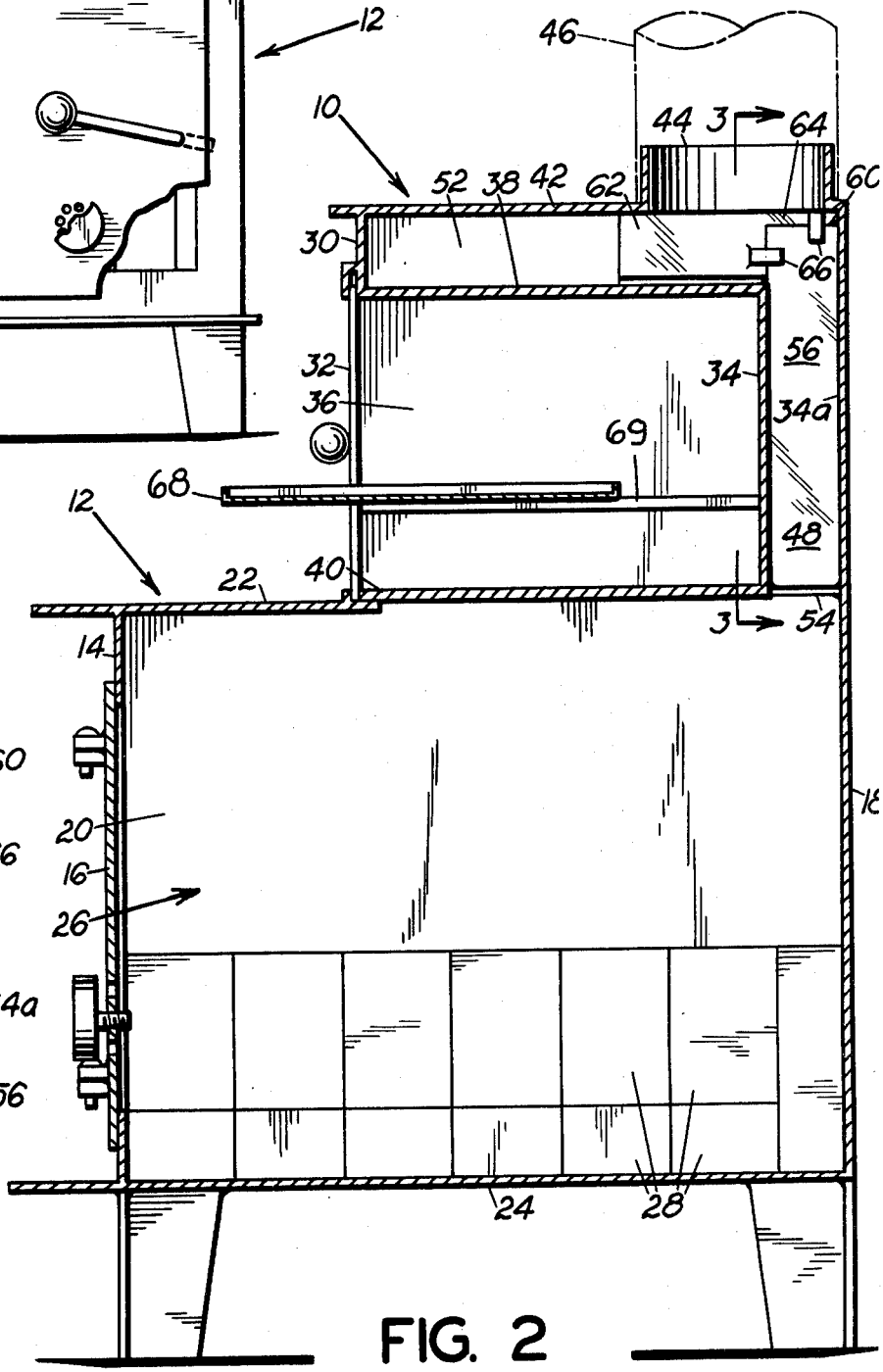
FIG. 2 is a vertical sectional view taken on the line 2—2 of FIG. 1.
Figure 5:
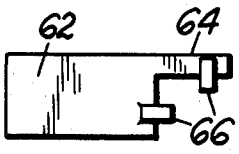
FIG. 5 is an elevational view of extension means utilized with a rear baffle in the structure.

In the embodiment of FIGS. 1-4, wherein the heating unit is combined with a stove 12, the bottom wall 40 of the heating unit may be formed by the top wall 22 of the stove or the latter wall may have an opening under wall 40. Wall 40 is provided with an opening 54 at the rear thereof for the outlet of smoke and heat. Secured between walls 34 and 34*a* in the space 48 are baffles 56 and 58 extending from a substantially central point in narrow spaced relation at the bottom and flaring outwardly toward the top in a V-shape and as best seen in FIGS. 2 and 4 terminating in a top edge 60 spaced a short distance from the top wall 42. It may be desirable, as will be explained in greater detail hereinafter, that the space between the top edges 60 and the top wall 42 be closed or diminished and furthermore that a forward extension be provided on the baffles in the top space 52. For this purpose, plate members 62, also shown in FIG. 5, are provided which have a width substantially equal to the height of space 52, or less if it is desired that only a portion of this space be closed. These plate members have a narrow rear extension 64 of a width equal substantially to, or less if desired than the space between the top edges 60 and the top wall 42. Members 62 have pairs of projecting tabs 66 thereon arranged to telescopically engage over upper portions of baffles 56 and 58 whereby such plate members are capable of being removably attached in place.

In the installation of the heating unit, if it is desired that the members 62 be used, they are readily attached by access through tubular projection 44, namely, by moving them through such projections to a position forward of the baffles and then moving them rearward so that the tabs 66 engage such baffles.

The plate member extensions 62 are used to add to the efficiency in heating in instances where the stove has good draft. In stoves having rather poor draft, the members 62 are not used whereby the upward flow of heat can move freely over the top edges 60 of the baffles. Such produces an efficient heating as above described; however, if the stove has a good draft as mentioned, the extensions 62 can be used to add to the difficulty of outlet of the smoke and heat and thus increase the heating efficiency. The extensions 62 are provided in selected lengths according to the draft efficiency of the stove, namely, the better the draft efficiency of the stove, the longer the extensions 62 can be.

Figure 3:
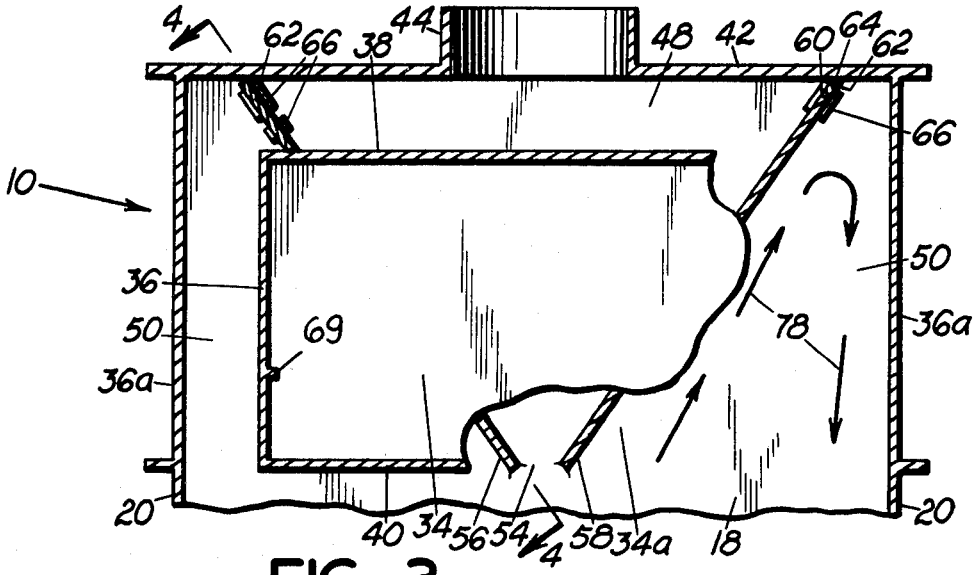
FIG. 3 is a fragmentary vertical sectional view, partly broken away, taken on the line 3—3 of FIG. 2.

The heating unit has an imperforate tray 68 slidably supported on side tracks 69, such tray being shown in FIG. 2 but omitted in FIGS. 3 and 4. One purpose of the tray 68 is to support articles in the heating unit for cooking. Another purpose of tray 68 is to form a path for convection air currents. That is, by opening doors 32 and pulling the tray partly outward as shown in FIG. 2, cold air currents are drawn in under the tray and circulate around the back thereof and discharge over the top and out the front in a natural forced flow of heated air. To provide the most effective flow of air for heating a surrounding room area, the tray 68 is located approximately one-third the distance up from the bottom 40.

Figure 6:
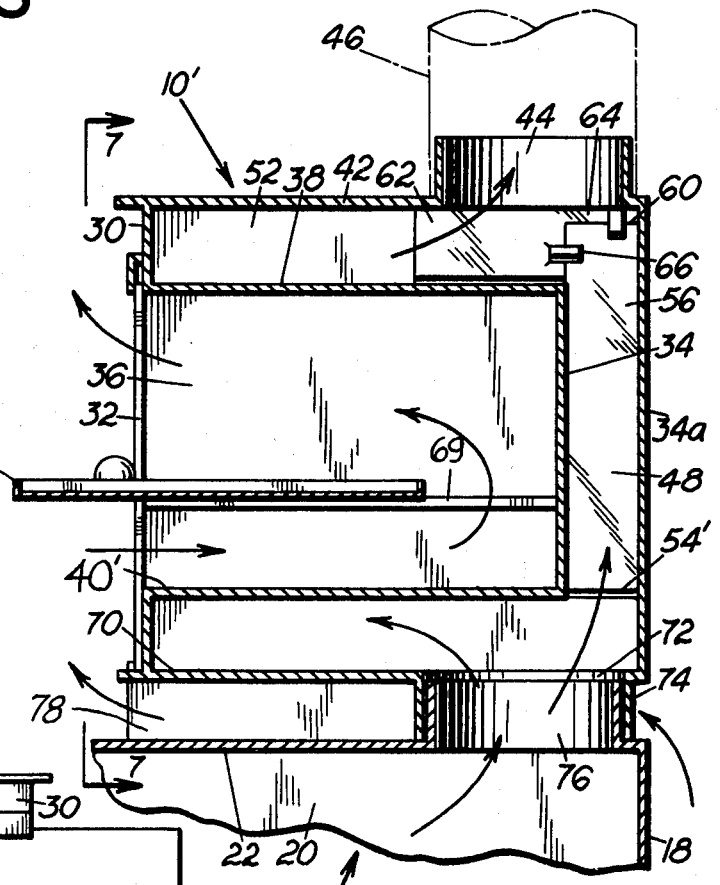
FIG. 6 is a fragmentary vertical sectional view similar to FIG. 2 but showing a second embodiment.
Figure 7:
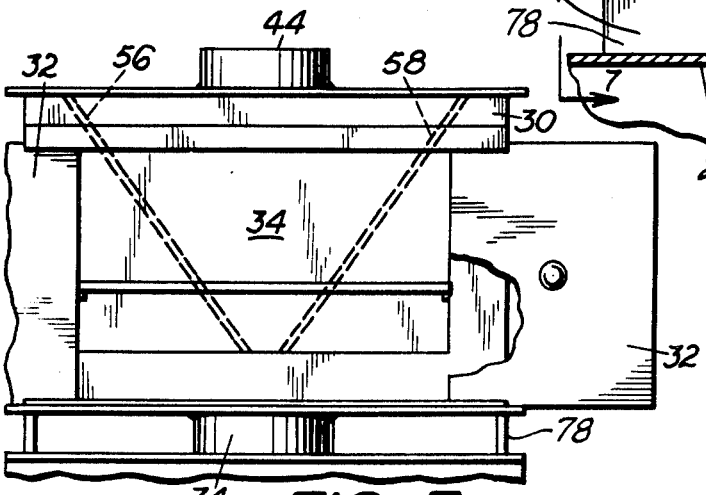
FIG. 7 is a fragmentary front elevational view taken on the line 7—7 of FIG. 6.

FIGS. 6 and 7 show a second embodiment of the heating unit, designated generally by the numeral 10'. The upper portion thereof is identical to the embodiment of FIG. 1 and is identified by similar reference numerals. In such embodiment, however, the bottom wall 40' is provided with a rear inlet 54' below the baffles 56 and 58 and the side, front and rear walls are extended downwardly to a second bottom wall 70 having an opening 72 provided with a depending tubular projection 74 arranged to telescopically fit over an upward tubular projection 76 on the top of a stove 12'. A pair of forwardly extending side feet 78 integral with the bottom wall 70 support the heating unit 10' at the front.

The purpose of the embodiment of FIGS. 6 and 7 is to support it on the top of an existing stove whereby smoke and the like are arranged to move upwardly through the heating unit and out the stovepipe 46. In the mounted relation of the unit 10' on the stove 12', the depending projection 74 fits down over the upward projection 76 on the stove and the front of the unit is supported by the feet 78. The location, size and arrangement of the feet 78 can be preselected according to the structure of the stove to which the unit is to be adapted such that the heating unit is supported in stable horizontal relation thereon.

According to the concept of the present invention, smoke and heat from the fire travel upwardly through opening 54 and circulate along the sides of the inner shell and over the top. In the embodiment of FIG. 6, such circulation will also occur under the wall 40'. The smoke and heat at the rearward portion of the heating unit impinge against baffles 56 and 58 which cause a reversing or slowing circulation in that the heat in travelling upwardly takes the path of circulation as shown by arrows 78 in FIG. 3 and thus must move forwardly out of the area of the baffles in order to move up the sides and over the top for discharge up the flue. This has been found to provide efficient heating of the inner shell and also for more efficiently heating surrounding room areas. It is the required circulation and the slow down of heat flow as provided by the baffles in association with the spaces around the inner shell that increase heating efficiency.

The present heating unit 10 or 10' can be primarily used as an oven for use with a heating stove in order to utilize heat from such stove for cooking purposes. Or, if desired, the doors 32 can be opened and the tray 70 partially extended in order to take advantage of the warm air flow through the oven as explained hereinbefore. Although the present heating unit is shown in combination with a stove, it could be mounted in a fireplace and used for the same purpose.

It is to be understood that the forms of our invention herein shown and described are to be taken as preferred examples of the same and that various other changes in the shape, size and arrangement of parts may be resorted to without departing from the spirit of our invention, or the scope of the subjoined claims. For example, the outlet 44 may be located in wall 34 between the baffles instead of at the top, the outlet of heat and smoke still being slowed in its travel to the flue to accomplish the increased efficiency in heating.

Having thus described our invention, we claim:

1. A heating unit comprising (a) an outer shell including rear, side, top and bottom walls, (b) an inner shell within said outer shell including rear, side, top and bottom walls, (c) said inner shell having a width of less dimension than the width of said outer shell forming a space on at least one side of said inner shell, (d) said inner shell also having a height of less dimension than the height of said outer shell forming a space at the top of said inner shell, (e) said inner shell furthermore having a length of less dimension than the length of said outer shell forming a space at the rear of said inner shell, (f) door means on the front of said outer and inner shells to cover a front opening, (g) a heat outlet at an upper portion of said outer shell whereby heat applied exteriorly to a lower portion of said heating unit flows by the side spaces, up the rear space into the top space, and out said outlet, (h) and a V-shaped baffle in the rear space between said inner and outer shells, (i) said baffle having upper edges terminating short of the top wall of said outer shell, (j) and extension means attachable on said baffle adjacent its upper edges for extending said edges upwardly to control the flow of heat, whereby heat flowing up the sides adjacent the back flares outwardly as it flows up the baffle so as to be circulated and slowed for efficiently heating the walls of said inner and outer shells.

2. The heating unit of claim 1 wherein said extension means also extends forwardly of said baffle to further control the flow of heat.

3. A heating unit comprising (a) an outer shell including rear, side, top and bottom walls, (b) an inner shell within said outer shell including rear, side, top and bottom walls, (c) said inner shell being of less dimension than said outer shell at the top, sides and rear for forming a heat circulating area between said two shells at the top, sides and rear, (d) a heat outlet at an upper portion of said outer shell whereby heat applied exteriorly to a lower portion of said heating unit flows up said circulating area and out said outlet, (e) and a pair of baffles in the rear space between said inner and outer shells, (f) said baffles extending from a lower portion of said inner shell to a point at an upper portion thereof adjacent to the top wall of said outer shell, (g) said baffles having a narrow spacing therebetween at the bottom and diverging upwardly relative to each other with the tops thereof disposed on opposite sides of said heat outlet, whereby heat flowing up the sides adjacent the rear walls of said inner and outer shells flares outwardly as it flows up the baffles so as to be slowed and circulated forwardly in said heat circulating areas for efficiently heating the walls of said outer shell.

4. The heating unit of claim 3 wherein the tops of said baffles terminate in upper edges, said edges being spaced a short distance from the top wall of said outer shell whereby heat can flow thereover and out said outlet.

5. A heating unit comprising (a) an outer shell including rear, side, top and bottom walls, (b) an inner shell within said outer shell including rear, side, top and bottom walls, (c) said inner shell being of less dimension than said outer shell at the top, sides and rear for forming a heat circulating area between said two shells at the top, sides and rear, (d) a heat outlet at an upper portion of said outer shell whereby heat applied exteriorly to a lower portion of said heating unit flows up said circulating area and out said outlet, (e) and a pair of baffles in a rear space between said inner and outer shells, (f) said baffles extending from a lower portion of said inner shell to a point at an upper portion thereof adjacent to the top wall of said outer shell and terminating in upper edges, (g) said baffles being disposed in upward diverging position relative to each other with said upper edges thereof disposed a short distance below the top wall of said outer shell and on opposite sides of said heat outlet, whereby heat flowing up the sides adjacent the rear walls of said inner and outer shells flares outwardly as it flows up the baffles so as to be slowed and circulated forwardly for efficiently heating the walls of said outer shell, (h) and extension means attachable on said baffles adjacent their upper edges for extending said edges upwardly to control the flow of heat.

6. The heating unit of claim 5 wherein said extension means also extend forwardly of said baffles to further control the flow of heat.

7. A heating unit comprising (a) an outer shell including rear, side, top and bottom walls, (b) an inner shell within said outer shell including rear, side, top and bottom walls, (c) said inner shell being of less dimension than said outer shell at the top, sides and rear for forming a heat circulating area between said two shells at the top, sides and rear, (d) a heat outlet at an upper portion of said outer shell whereby heat applied exteriorly to a lower portion of said heating unit flows up said circulating area and out said outlet, (e) a pair of baffles in the rear space between said inner and outer shells, (f) said baffles extending from a lower portion of said inner shell to a point at an upper portion thereof adjacent to the top wall of said outer shell, (g) said baffles being disposed in upward diverging position relative to each other with the tops thereof disposed on opposite sides of said heat outlet, whereby heat flowing up the sides adjacent the rear walls of said inner and outer shells flares outwardly as it flows up the baffles so as to be slowed and circulated forwardly for efficiently heating the walls of said outer shell, (h) said heating unit having a front opening, (i) and an imperforate tray in said inner shell extending from side to side thereof above the bottom, said tray projecting forwardly through said opening and disposed forwardly of the rear wall of said inner shell whereby cold air currents move by convection through said opening, under said tray, and around the back and forwardly over said tray out the opening.

8. In combination (a) a stove, (b) a heating unit supported on said stove and receiving its heat therefrom, (c) said heating unit comprising outer and inner shells each having rear, side, top and bottom walls, (d) said inner shell being of less dimension than said outer shell at the top, sides and rear for forming a heat circulating area between said two shells at the top, sides and rear, (e) a heat outlet at an upper portion of said outer shell whereby heat applied from said stove to a lower portion of said heating unit flows up said circulating area and out said outlet, (f) and a pair of baffles in the rear space between said inner and outer shells, (g) said baffles extending from a lower portion of said inner shell to a point at an upper portion thereof adjacent to the top wall of said outer shell, (h) said baffles being disposed in upward diverging position relative to each other with the tops thereof disposed on opposite sides of said heat outlet, whereby heat flowing up the sides adjacent the rear walls of said inner and outer shells flares outwardly as it flows up the baffles so as to be slowed and circulated forwardly for efficiently heating the walls of said outer shell.

9. The combination of claim 8 including a top outlet on said stove, said heating unit being supported on said stove and having a bottom inlet in communication with said outlet for receiving heat therefrom.

* * * * *